US007544322B2

(12) United States Patent
Nadler et al.

(10) Patent No.: US 7,544,322 B2
(45) Date of Patent: Jun. 9, 2009

(54) PROCESS FOR THE PRESSURELESS SINTERING OF METAL ALLOYS; AND APPLICATION TO THE MANUFACTURE OF HOLLOW SPHERES

(75) Inventors: Jason Nadler, Paris (FR); Pierre Josso, Issy les Moulineaux (FR); Marie-Pierre Bacos, Antony (FR); Florin Paun, Issy les Moulineaux (FR)

(73) Assignee: ONERA (Office National d'Etudes et de Recherches aerospatiales), Chatillon (FR)

( * ) Notice: Subject to any disclaimer, the term of this patent is extended or adjusted under 35 U.S.C. 154(b) by 140 days.

(21) Appl. No.: 11/482,500

(22) Filed: Jul. 7, 2006

(65) Prior Publication Data

US 2007/0108255 A1 May 17, 2007

Related U.S. Application Data

(60) Provisional application No. 60/414,534, filed on Jul. 20, 2005.

(30) Foreign Application Priority Data

Jul. 7, 2005 (FR) ..... 05 07256

(51) Int. Cl.
*B22F 3/10* (2006.01)
*B22F 3/22* (2006.01)

(52) U.S. Cl. ..... 419/36; 419/26

(58) Field of Classification Search ..... 419/2, 419/36, 60, 40

See application file for complete search history.

(56) References Cited

U.S. PATENT DOCUMENTS

| | | | | | |
|---|---|---|---|---|---|
| 3,403,009 | A | * | 9/1968 | Bergstrom | 75/237 |
| 3,528,809 | A | * | 9/1970 | Farnand et al. | 264/635 |
| 3,708,285 | A | * | 1/1973 | Scheyer | 419/36 |
| 3,871,630 | A | * | 3/1975 | Wanetzky et al. | 266/156 |
| 4,722,826 | A | * | 2/1988 | Poole | 419/11 |
| 4,775,598 | A | * | 10/1988 | Jaeckel | 428/550 |
| 4,836,980 | A | * | 6/1989 | Kashiwadani et al. | 419/36 |
| 5,073,459 | A | * | 12/1991 | Smarsly et al. | 428/550 |
| 5,122,326 | A | * | 6/1992 | Jackson et al. | 264/102 |
| 5,266,264 | A | * | 11/1993 | Miura et al. | 419/37 |
| 6,299,664 | B1 | | 10/2001 | Matsumoto et al. | |
| 6,689,311 | B2 | * | 2/2004 | Morita et al. | 419/8 |
| 2007/0065329 | A1 | * | 3/2007 | Nyberg et al. | 419/60 |

FOREIGN PATENT DOCUMENTS

| | | | |
|---|---|---|---|
| JP | 02-209402 | * | 8/1990 |
| WO | WO0076697 | | 12/2000 |

OTHER PUBLICATIONS

Search Report for France patent application No. 0507256, published Apr. 10, 2006, 1 pg.

* cited by examiner

*Primary Examiner*—Roy King
*Assistant Examiner*—Ngoclan T Mai
(74) *Attorney, Agent, or Firm*—Christie, Parker & Hale, LLP

(57) ABSTRACT

Hollow metal spheres are heated in a high vacuum in the presence of an organic substance, at a temperature at least equal to the melting point of a eutectic between carbon and the metallic constituents of the said spheres.

9 Claims, No Drawings

PROCESS FOR THE PRESSURELESS SINTERING OF METAL ALLOYS; AND APPLICATION TO THE MANUFACTURE OF HOLLOW SPHERES

CROSS-REFERENCED TO RELATED APPLICATION(S)

This application claims the benefit of U.S. Provisional Application 60/414,534, filed on Jul. 20, 2005, and claims priority of France Patent Application No. 0507256, filed on Jul. 7, 2005.

The invention relates to a process for binding metal bodies together by sintering.

The sound emission from a commercial aircraft may reach up to 155 dB at take-off, a value above the auditory pain threshold estimated to be 130 dB. It is therefore desirable to reduce this level of sound emission. One way of trying to solve this problem consists in absorbing the noise at one of its points of emission, that is to say at the engines. Solutions have already been developed in the "cold" parts of engines, but the "hot" parts have at the present time not been the subject of any acoustic treatment. It is therefore desirable to develop a material having an acoustic absorption function designed for the hot parts of aircraft engines. To do this, it is contemplated to develop a nozzle capable of partly absorbing the noise produced inside the engine.

Moreover, the manufacture of systems capable of absorbing a large amount of kinetic energy, while still having a very low weight, is of undeniable advantage for fulfilling a function of protecting both people and property.

One system that can meet these various specifications involves the use of cellular materials based on spheres.

However, at the present time only nickel-based spheres and ceramic or organic spheres are commercially available. Assembling these elements by sintering does not allow an infinite variety of desirable combinations for achieving the above objectives and furthermore the temperature capabilities are extremely limited, as regards both mechanical strength and resistance to the oxidizing and corrosive environment encountered in aircraft engines.

Powder metallurgy can be used to reproduce a bulk metal alloy by sintering its powder. There are many methods of densification, namely dynamic or isostatic pressing, compacting, etc., these methods being applied at high temperature, i.e. at about two-thirds of the melting point. In contrast, densification by natural sintering at the same temperature, that is to say without the application of external pressure other than the Earth's gravitational field, results in a porous alloy.

To solve these difficulties, it was decided to study a novel material which would have the following advantages:

- construction from a metal alloy resulting from powder metallurgy, but densification of the alloy taking place without the use of external pressure;
- possibility of having performance characteristics predicted in a specification obtained from modeling;
- possibility of being made of the material most suited to the use;
- possibility of having dense walls in a single operation; and
- possibility of being multifunctional.

The invention relates to a process for binding metal bodies together by sintering, in which the said bodies are heated in a high vacuum in the presence of an organic substance, at a temperature at least equal to the melting point of a eutectic between carbon and the metallic constituents of the said bodies.

Optional features of the invention, either additional or alternative, are given below:

- The said vacuum is better than $10^{-3}$ Pa.
- The said vacuum is better than $10^{-4}$ Pa.
- The sintering is carried out in the absence of mechanical stress.
- The said bodies are powder grains.
- A blend of a metal powder, an organic binder and, where appropriate, a solvent is heated under the said vacuum at the said temperature in order under the said vacuum at the said temperature.
- A multiplicity of solid cores made of an organic material, each covered with a blend of a metal powder and an organic adhesive, is heated under the said vacuum at the said temperature in order to obtain a multiplicity of hollow metal bodies having substantially the shape and the dimensions of the starting cores, these bodies being bonded together by sintering.
- A multiplicity of hollow metal bodies bonded together by means of an organic adhesive is heated under the said vacuum at the said temperature, bonding by sintering replacing the bonding by adhesion.
- The sintering is followed by a decarburization treatment.
- The said metal bodies are made of nickel and/or cobalt or alloys of these metals, in particular superalloys based on nickel and/or cobalt.

According to one aspect of the invention, the final object is obtained from a mould or a preform into which a metal powder is introduced, the said powder being prepared so as to form a slip or paste or any other thixotropic blend easy to inject.

According to another aspect, a metal powder is deposited on the surface of bodies such as balls. To do so, the powder of the alloy desired for the shell is bonded to the surface of the spheres.

Thus, the invention may comprise the following steps:

- production of a metal alloy powder/organic precursor blend so as to obtain a thixotropic blend capable of being injected into a mould or preform;
- application, so as to form a hollow sphere; and
- optional protection of the material by aluminizing.

In the case of the manufacture of hollow spheres, it is possible to use loose stacking techniques without recourse to the teachings of FR 2 585 445 A.

The invention relies on the following observations.

1. An organic body, that is to say one consisting of molecules based on the chemistry of carbon, when it is subjected to a high vacuum ($P<10^{-4}$ Pa) and to a high temperature ($T>150°$ C.), goes from the solid (or liquid) state to the vapor state, either by direct evaporation or sublimation or by decomposition into one or more elementary substances which themselves may be converted into the vapor state. For suitably chosen organic substances, more than 90% of the material thus exposed to the vacuum at high temperature will vaporize. However in particular if decomposition takes place, there may remain on the surface of the container of the said organic substance traces of elemental, and therefore highly reactive, carbon.

2. A lightly oxidized metal element, that is to say one covered with a spontaneous layer of oxides resulting from this material coming into contact at room temperature with an atmosphere rich in oxygen and in water vapor, and brought into contact with elemental carbon under a vacuum of better than $10^{-4}$ Pa and at a temperature above 500° C., is spontaneously deoxidized according to the following reactions:

$$M_xO_y+yC \rightarrow xM+yCO \uparrow$$

$$M_xO_y+yCO \rightarrow xM+yCO_2 \uparrow$$

3. It is possible to obtain eutectic melting using carbon as flux. The following form in particular a eutectic reaction with carbon: Co ($T_m$=1320° C.), Cr ($T_m$=1534° C.), Fe ($T_m$=1153° C.), Ni ($T_m$=1326° C.) and Pd ($T_m$=1504° C.). It is therefore readily possible to obtain sintering with any alloy powder whatsoever, especially one based on nickel and/or cobalt. To do this, all that is required is to reduce to powder form the alloy that is desired tc reproduce (advantageously, but not necessarily, with particle sizes centered on 40 μm) and to make a slip using the powder to which a binder has been added, the said binder possibly being, for example, an epoxy adhesive diluted in ethyl alcohol, polymethyl methacrylate dissolved in acetone or methyl cellulose dissolved in water. The blend thus formed is dried in an oven (T>80° C.) so as to drive off the solvent (ethyl alcohol, acetone or water or any polar solvent). It is then put into a chamber under a vacuum of better than $10^{-4}$ Pa and annealed to above the melting point of the metal/carbon eutectic. At the end of the experiment what is obtained is the reproduced starting alloy, and chemical analyses carried out on the cast ingot obtained show that the contamination with carbon remains within the tolerance limits. This technique is applicable to the manufacture of hollow spheres made of a superalloy.

The invention is illustrated below by non-limiting examples.

EXAMPLE I

The aim was to sinter Astroloy powder, Astroloy being a superalloy based on nickel having the following composition in percent by weight: Cr 15, Co 17, Mo 5.3, Al 4.0, Ti 3.5, C 0.06, B 0.03 and Ni the balance up to 100, in order to reproduce the initial superalloy. To do this, the above powder was mixed with polyvinyl alcohol and with water as solvent. The slip obtained contained 60% metal powder by volume. After heating in an oven for 16 hours at 80° C. for the purpose of removing the water, the assembly was placed in a chamber under a vacuum of better than $10^{-3}$ Pa. The assembly was heated slowly (at about 1° C. per minute) until the decomposition temperature of the organic binder (about 450° C.) was reached. After a temperature hold for about two hours, the assembly was then heated up to 1250° C. at a rate of 100° C. per minute. After a hold for ten minutes, the assembly was rapidly cooled down to room temperature.

What was obtained from the oven was a solid material, free of any porosity. Metallographic examination revealed the conventional structure of the starting superalloy, namely a γ-nickel matrix in which $Ni_3(Al,Ti)$ γ'-precipitates were dispersed. The chemical composition was consistent with that of the initial material.

If an excess of carbon was detected, the content of this element could be reduced by a decarburization treatment, such as a heat treatment in wet hydrogen, well known to those skilled in the art.

EXAMPLE II

A technique consisting in adhesively bonding superalloy powders directly to the surface of balls was used. Compared with composite electroplating, the adhesive bonding technique makes it possible to obtain spheres with a composition that is much closer to that of a superalloy. In fact, it offers the possibility of an infinite number of chemical compositions, these depending on the nature of the powder used.

The powders were directly bonded to the surface of spherical polystyrene supports using the following operating method:

- about 90 $cm^3$ of Astroloy powder ($D_{50}$ ≃10 μm) were blended with 10 $cm^3$ of epoxy adhesive of the ARALDITE 2011 brand in a watch glass using an applicator gun that allowed the various quantities of adhesive and hardener to be metered in order to obtain the optimum blend recommended by the manufacturer;
- in a second stage, a hundred or so polystyrene balls were then added thereto;
- the balls were then rolled in the powder/epoxy adhesive blend using a second watch glass; and
- as soon as the entire surface of the supports was covered, the balls thus coated were placed on a perforated tray and oven-dried at 60° C.

The powder/adhesive thickness obtained was about 0.1 mm.

To maintain sufficient mechanical strength of the sphere that will become hollow by removal of the support, a novel type of heat treatment was developed. This involved placing the balls on a support of appropriate shape according to the final structure to be obtained, for example a V-shaped support in order to obtain a compact stack, and these were then placed in a vacuum oven in an alumina pot provided with an apertured lid intended to keep the balls in place during the pumping operations. Once a vacuum of better than $10^{-3}$ Pa was obtained, the following heat treatment was applied:

- temperature rise at 0.5° C. per minute up to a temperature of 450° C.;
- temperature hold for 120 minutes;
- temperature rise at 100° C. per minute up to a temperature of 1250° C.;
- temperature hold for 20 minutes; and
- rapid cooling (from 1250° C. down to 600° C. in about 20 minutes).

This procedure was chosen for its ease of processing, minimizing the number of steps for the purpose of easier industrialization for a defined application. During the vacuum annealing, the polystyrene and the epoxy adhesive together enrich the surface of each powder grain with a little elemental carbon. Once this carbon has formed, each powder grain then undergoes a deoxidation reaction. Finally, when at the melting point of the eutectic formed by carbon with Ni and the other constituent elements of the superalloy, i.e. 1250° C., the surface of each powder grain undergoes partial melting. In addition, owing to the presence of a liquid phase the balls in the process of being formed join together. This technique makes it possible to obtain an entirely satisfactory structure formed from a multiplicity of nickel-based superalloy balls.

EXAMPLE III

The purpose of this example was to carry out eutectic brazing simply by contaminating pure nickel objects with carbon. More particularly, the aim was to bond together hollow pure nickel spheres supplied by the French company Ateca.

The balls were bonded with the epoxy adhesive ARALDITE 2011 diluted in alcohol, the purpose of this dilution being to increase the handling time of the balls before curing. After an oven treatment in air at a temperature of 80° C. for a time of 2 hours, the set of balls was placed in a chamber under a vacuum of better than $10^{-3}$ Pa. The whole assembly was then subjected to the following heating program: temperature rise at 100° C. per minute up to a temperature of 1350° C., temperature hold for 10 minutes and rapid cooling (from 1350° C. to 600° C. in about 25 minutes) After cooling, it was found that the balls were brazed together, as shown by the menisci formed at their points of contact. It was impossible to separate the balls.

For comparison, spheres taken from the same batch were carefully degreased and subjected to the same vacuum heat treatment. At the end of the experiment, no meniscus had formed at the points of contact. Only a small amount of interdiffusion was observed at the same points of contact, but the balls were easily separated.

Of course, it is possible to apply the invention to metallic materials other than those mentioned in the above examples, and especially to all superalloys based on nickel and/or cobalt.

The invention claimed is:

1. Process for binding metal bodies together by sintering, comprising:

bonding by adhesion the metal bodies together by an organic substance;

heating the metal bodies in a vacuum better than $10^{-4}$ Pa, at a temperature at least equal to the melting point of a eutectic between carbon and the metallic constituents of the metal bodies;

decomposing the organic substance due the heating of the metal bodies;

producing elemental carbon by the decomposed organic substance;

deoxidizing the metal bodies by the produced elemental carbon;

utilizing the produced elemental carbon as a flux to obtain a eutectic melting of the metal bodies; and replacing the bonding by adhesion of the metal bodies with bonding by sintering of the metal bodies together.

2. Process according to claim 1, in which the sintering is carried out in the absence of mechanical stress.

3. Process according to claim 1, in which the metal bodies are powder grains.

4. Process according to claim 3, in which a blend of a metal powder and an organic binder and/or a solvent is heated under the vacuum at the temperature.

5. Process according to claim 3, in which a multiplicity of solid cores made of an organic material, each covered with a blend of a metal powder and an organic adhesive, is heated under the vacuum at the temperature in order to obtain a multiplicity of hollow metal bodies having substantially the shape and the dimensions of the starting cores, these metal bodies being bonded together by sintering.

6. Process according to claim 1 in which a multiplicity of hollow metal bodies bonded together by means of an organic adhesive is heated under the vacuum at the temperature, bonding by sintering replacing the bonding by adhesion.

7. Process according to claim 1, in which the bonding by sintering is followed by a decarburization treatment.

8. Process according to claim 1, in which the metal bodies are made of nickel and/or cobalt or alloys of these metals.

9. Process according to claim 1, in which the metal bodies are made of superalloys based on nickel and/or cobalt.

* * * * *

UNITED STATES PATENT AND TRADEMARK OFFICE

CERTIFICATE OF CORRECTION

PATENT NO. : 7,544,322 B2
APPLICATION NO. : 11/482500
DATED : June 9, 2009
INVENTOR(S) : Jason Nadler et al.

It is certified that error appears in the above-identified patent and that said Letters Patent is hereby corrected as shown below:

| | |
|---|---|
| Column 5, Claim 1, line 22 | After "due"<br>Insert -- to -- |

Signed and Sealed this

Twenty-sixth Day of October, 2010

David J. Kappos

David J. Kappos
*Director of the United States Patent and Trademark Office*